US008439948B1

(12) United States Patent
King et al.

(10) Patent No.: US 8,439,948 B1
(45) Date of Patent: May 14, 2013

(54) CHIROPRACTIC TABLE SYSTEM

(75) Inventors: Wallace E. King, Grand Forks, ND (US); Gerald G. Voegele, Grand Forks, ND (US)

(73) Assignee: Wallace E. King, Grand Forks, ND (US)

( * ) Notice: Subject to any disclaimer, the term of this patent is extended or adjusted under 35 U.S.C. 154(b) by 0 days.

(21) Appl. No.: 13/364,006

(22) Filed: Feb. 1, 2012

Related U.S. Application Data

(60) Provisional application No. 61/462,264, filed on Feb. 1, 2011.

(51) Int. Cl.

| | |
|---|---|
| ***A61G 13/009*** | (2006.01) |
| ***A61G 13/123*** | (2006.01) |
| ***A61H 1/0218*** | (2006.01) |
| ***A61H 1/0244*** | (2006.01) |

(52) U.S. Cl.
USPC ..... 606/244; 606/241; 606/242

(58) Field of Classification Search ..... 601/84, 601/85, 86, 97, 98, 100; 602/32, 33, 34, 602/35, 36, 40; 606/237, 241, 242, 243, 606/244, 245
See application file for complete search history.

(56) References Cited

U.S. PATENT DOCUMENTS

| | | | | |
|---|---|---|---|---|
| 1,617,593 | A * | 2/1927 | Hardy | 606/239 |
| 2,666,429 | A * | 1/1954 | Alexander et al. | 601/92 |
| 2,856,917 | A * | 10/1958 | Mack | 601/92 |
| 2,869,539 | A * | 1/1959 | Mosse | 601/98 |
| 5,443,439 | A * | 8/1995 | Ohshita | 601/90 |
| 5,741,218 | A * | 4/1998 | Fujii | 601/90 |
| 5,876,358 | A | 3/1999 | Goebel | |
| 6,077,293 | A | 6/2000 | King | |
| 6,517,500 | B2 * | 2/2003 | Ichikawa | 601/98 |
| 6,866,644 | B1 * | 3/2005 | Kost | 601/49 |
| 7,060,046 | B2 * | 6/2006 | Tanaka et al. | 602/33 |
| 2003/0045818 | A1 * | 3/2003 | Huang | 601/97 |
| 2006/0155221 | A1 * | 7/2006 | Kim | 601/29 |
| 2008/0077059 | A1 * | 3/2008 | Morikawa et al. | 601/98 |
| 2009/0247917 | A1 * | 10/2009 | Park | 601/99 |

* cited by examiner

*Primary Examiner* — Justine Yu
*Assistant Examiner* — Raymond G Chen
(74) *Attorney, Agent, or Firm* — Michael S. Neustel

(57) ABSTRACT

A chiropractic table system for providing effective treatment of sacroiliac joint pain in a patient. The chiropractic table system generally includes a table with an upper opening, a first support member extending through the upper opening and a second support member extending through the upper opening. The support members engage the hip portion of a patient lying upon the table. The support members are separated thereby separating the sacroiliac joints, then the support members are counter-pivoted with respect to one another thereby torquing the hip portion of the patient and then the support members are quickly lowered a distance to set the hip portion of the patient as desired.

17 Claims, 18 Drawing Sheets

CHIROPRACTIC TABLE SYSTEM

CROSS REFERENCE TO RELATED APPLICATIONS

I hereby claim benefit under Title 35, United States Code, Section 119(e) of U.S. provisional patent application Ser. No. 61/462,264 filed Feb. 1, 2011. The 61/462,264 application is currently pending. The 61/462,264 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a chiropractic table and more specifically it relates to a chiropractic table system for providing effective treatment of sacroiliac joint pain in a patient.

2. Description of the Related Art

Any discussion of the related art throughout the specification should in no way be considered as an admission that such related art is widely known or forms part of common general knowledge in the field.

Chiropractic tables have been in use for years to support a chiropractic patient thereupon. Conventional chiropractic tables are typically comprised of a cushioned upper surface and may have an opening for the face of the patient. Some chiropractic tables include an extended headpiece that is adjustable. The chiropractic patient lays upon the upper surface of the chiropractic table facing downwardly or upwardly depending upon the chiropractic procedure the chiropractor intends to perform.

Patients with lower back pain (e.g. subluxation) and/or sacroiliac joint pain can be difficult for a chiropractor to work upon because of the complex sacroiliac joints which are located at the bottom of the patient's back on both sides of the spine. The sacroiliac joints are part of the rear part of the pelvic girdle. In particular, the sacroiliac joints are positioned between the sacrum (vertebrae S1-S5) and the ilium (the two hipbones). The sacroiliac joints allow torsional/twisting movements when an individual moves their legs. Unfortunately, the sacroiliac joints and surrounding areas are susceptible to injury and pain because of the large amount of stress and twisting placed upon the joints. Because the ilium with the sacrum form the foundation of a biped human, it is important that they are properly aligned to ensure that the upper portion of the patient's body is in proper alignment.

The sacrum is similar to a keystone, wherein the sacrum is substantially triangular shaped and positioned between the ilium in a wedged manner. Similar to a keystone, it is important for the sacrum to be properly aligned for a stable foundation for a biped human. When the sacrum is not properly aligned within the ilium, a patient may experience pain and discomfort in the sacroiliac joint area and within the lower back.

Sacroiliac joint pain may be caused by various issues such as but not limited to traumatic injuries (e.g. landing on the buttocks) and biomechanical (e.g. leg length discrepancy). Treating sacroiliac joint pain can be difficult to treat upon a conventional chiropractic table because of the complex anatomy and movement patterns of the sacroiliac joints. U.S. Pat. No. 6,077,293 to Dr. Wallace E. King discloses a Chiropractic Table that is capable of treating lower back pain and sacroiliac joint pain. However, the Chiropractic Table disclosed in King is limited to separation and elevation adjustment of the sacroiliac joints without the ability of torsion adjustment.

Because of the inherent problems with the related art, there is a need for a new and improved chiropractic table system for providing effective treatment of sacroiliac joint pain in a patient.

BRIEF SUMMARY OF THE INVENTION

The invention generally relates to a chiropractic table which includes a table with an upper opening, a first support member extending through the upper opening and a second support member extending through the upper opening. The support members engage the hip portion of a patient lying upon the table. The support members are separated thereby separating the sacroiliac joints, then the support members are counter-pivoted with respect to one another thereby torquing the hip portion of the patient and then the support members are quickly lowered a distance to set the hip portion of the patient as desired.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1A:
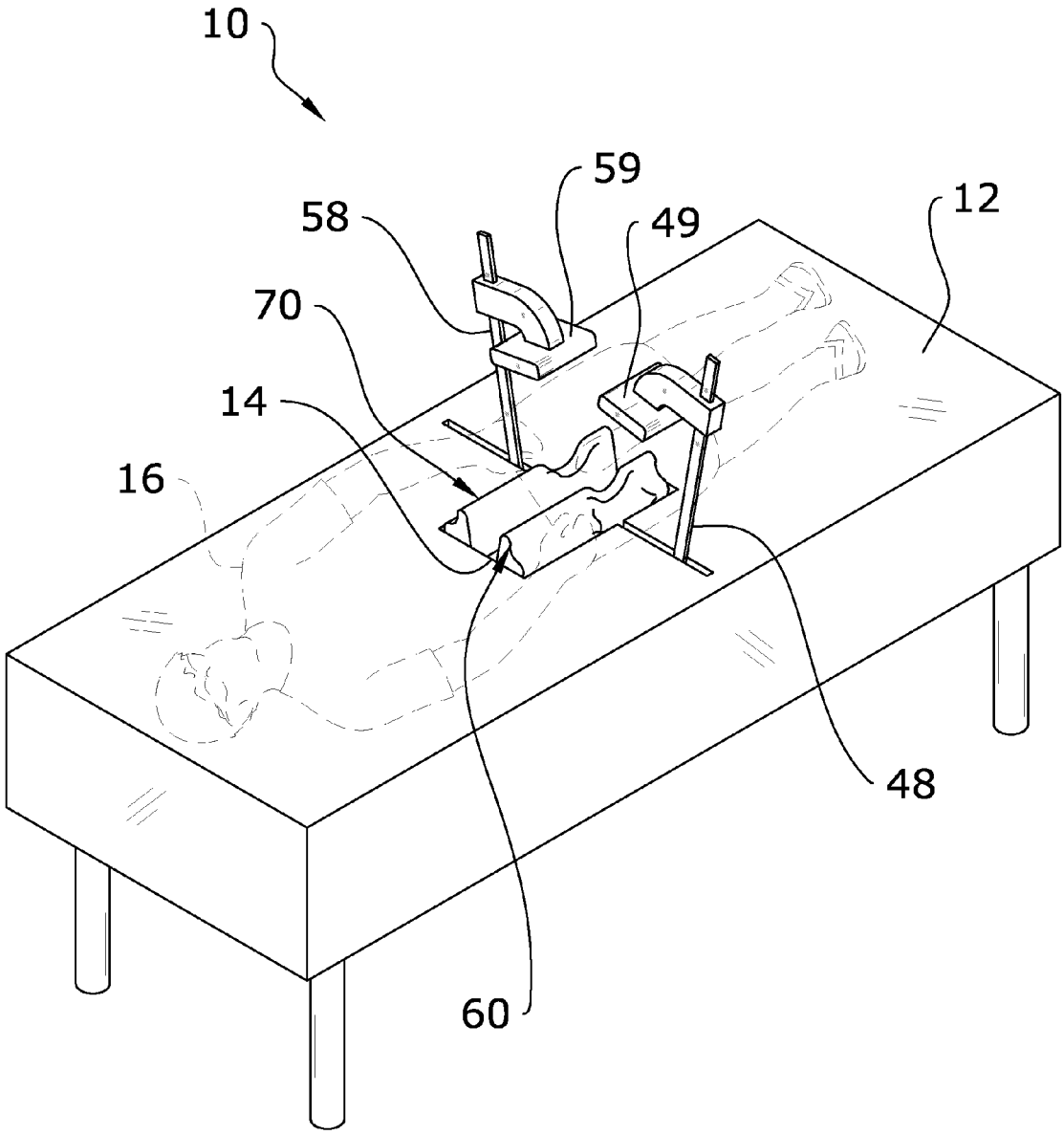
FIG. 1*a* is an upper perspective view of the present invention with a patient positioned on the table.

Turning now descriptively to the drawings, in which similar reference characters denote similar elements throughout the several views, FIGS. 1 through 10 illustrate a chiropractic table system 10, which comprises a table 12 with an upper opening 14, a first support member 60 extending through the upper opening 14 and a second support member 70 extending through the upper opening 14. The support members engage the hip portion of a patient 16 lying upon the table 12. The support members are separated thereby separating the sacroiliac joints, then the support members are counter-pivoted with respect to one another thereby torquing the hip portion of the patient 16 and then the support members are quickly lowered a distance to set the hip portion of the patient 16 as desired. U.S. Pat. No. 6,077,293 to Dr. Wallace E. King discloses a related Chiropractic Table and is incorporated by reference herein.

B. Exemplary Table

Figure 1B:
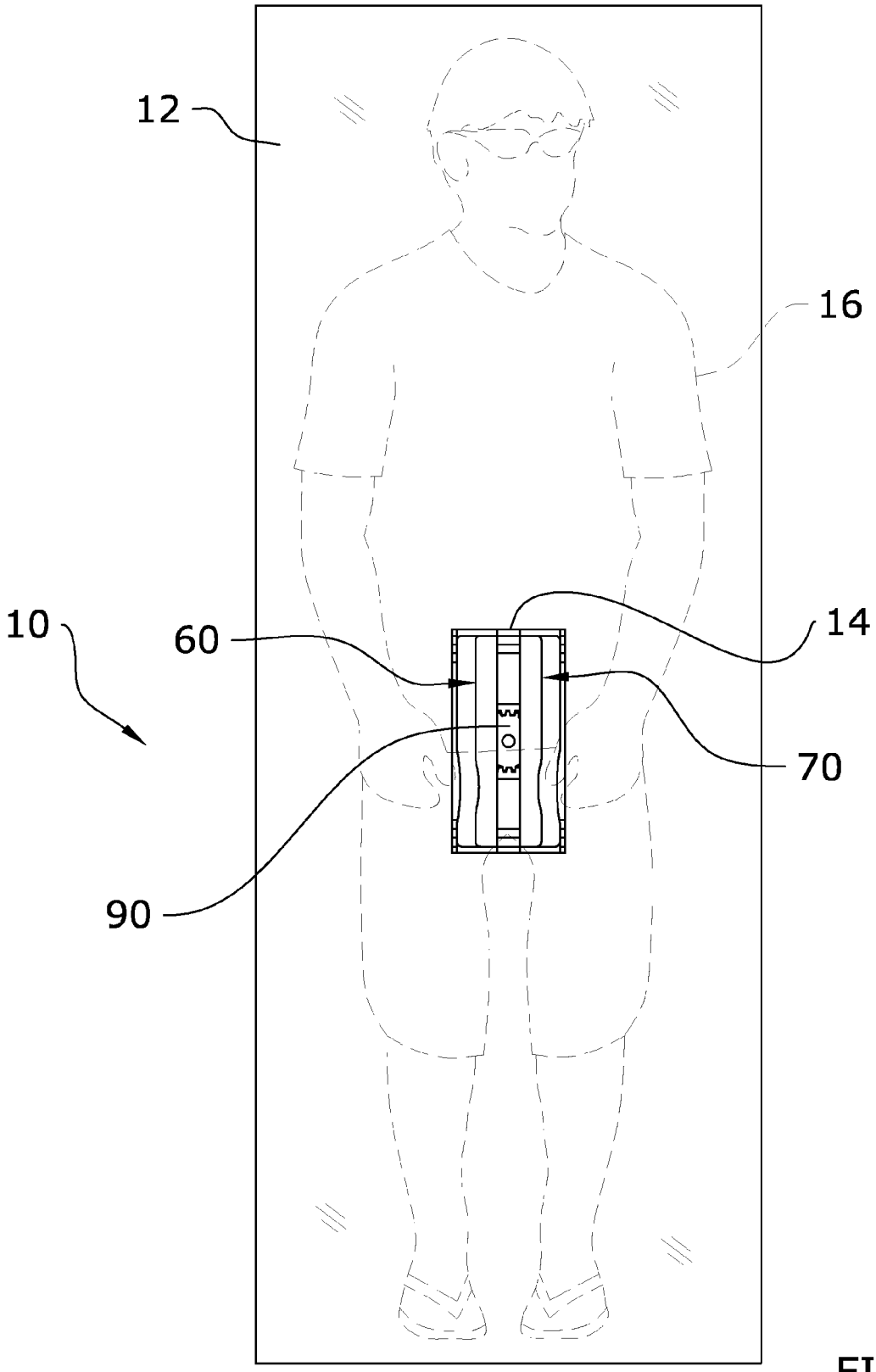
FIG. 1*b* is a top view of the present invention with a patient positioned on the table.

FIGS. 1*a* through 1*e* illustrate an exemplary table 12 suitable for use with the present invention. The table 12 includes an upper surface that the patient 16 lays upon facing upwardly as illustrated in FIGS. 1*a* and 1*b* of the drawings. The table 12 is preferably comprised of an elongated structure capable of supporting at least an average height human. The table 12 may be comprised of any structure commonly utilized within the medical profession to support a patient 16 in a substantially horizontal manner.

Figure 1C:
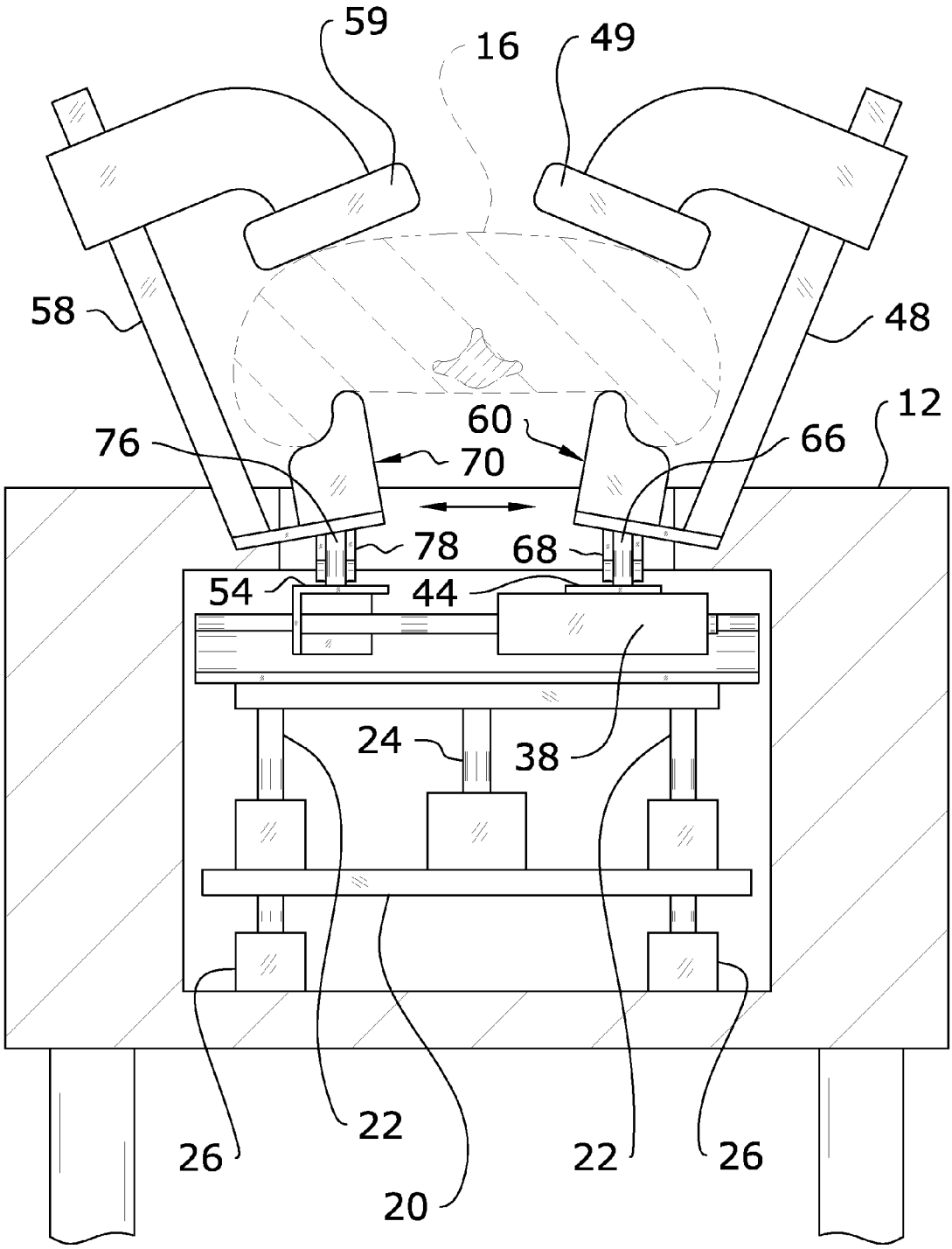
FIG. 1*c* a front cutaway view illustrating the present invention within the table with the hips of the patient positioned upon the support members and with the support members separated to separate the sacroiliac joints.
Figure 1D:
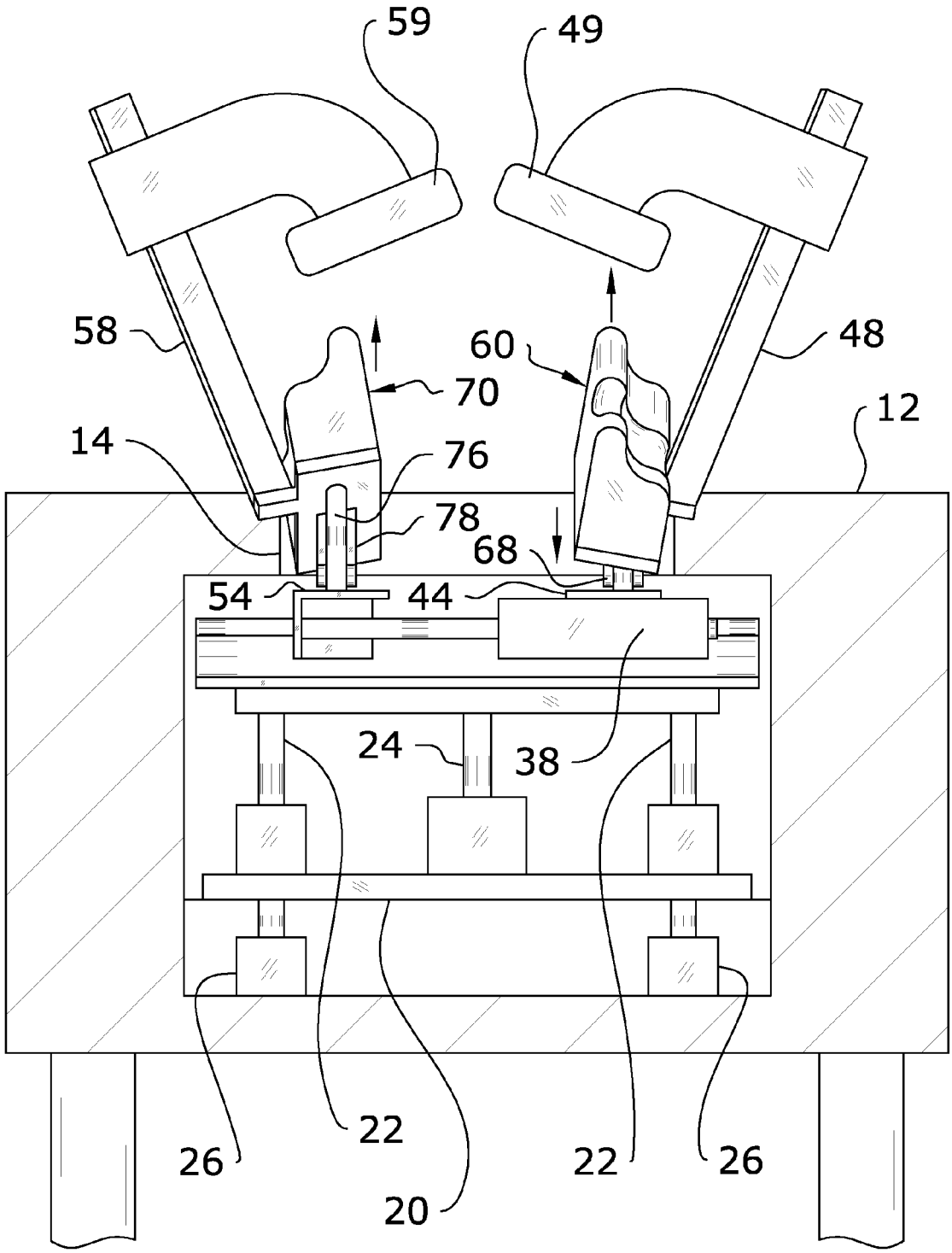
FIG. 1*d* a front cutaway view illustrating the present invention within the table with the hips of the patient positioned upon the support members and with the support members counter-pivoted in a first direction to torque the hip region of the patient.
Figure 1E:
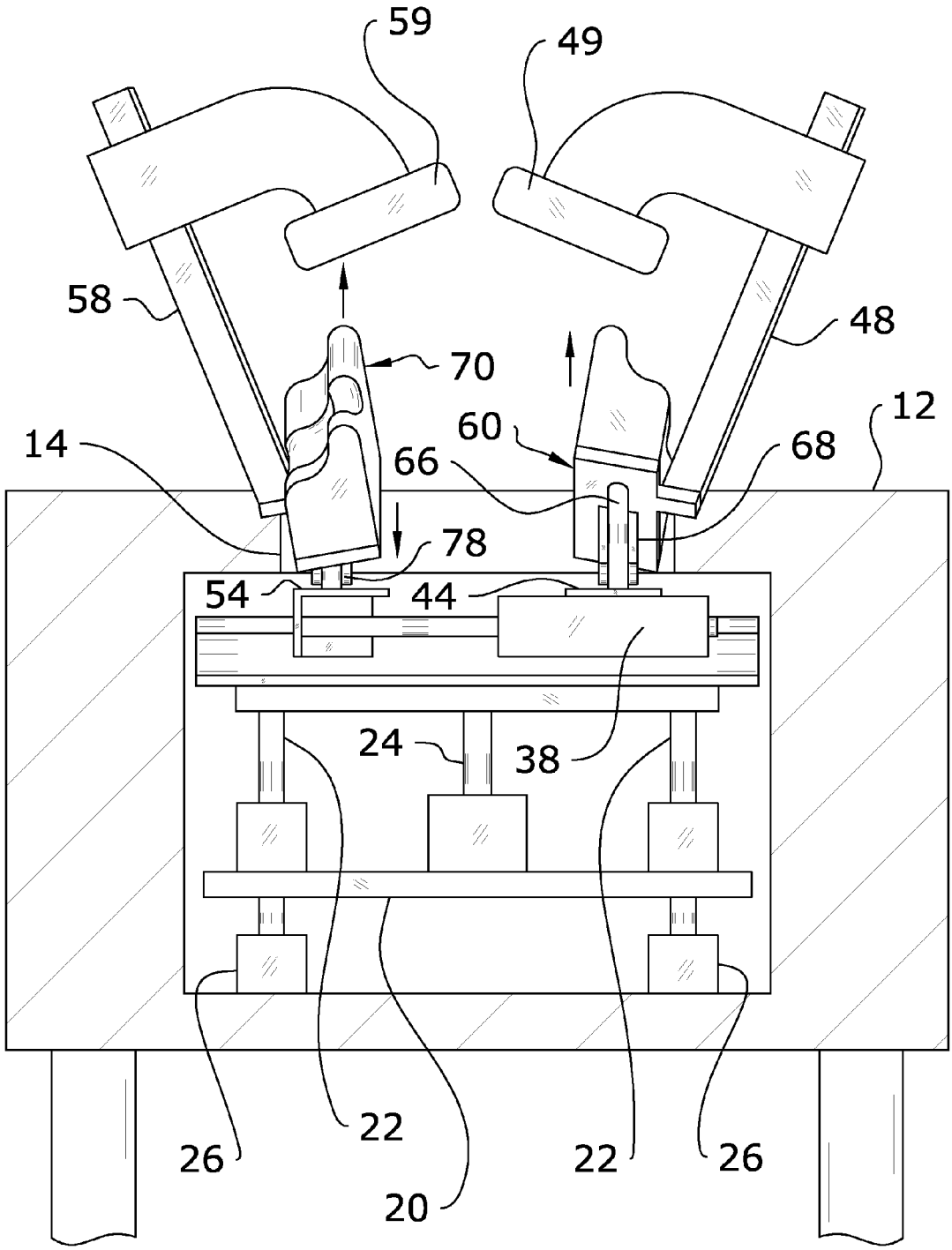
FIG. 1*e* a front cutaway view illustrating the present invention within the table with the hips of the patient positioned upon the support members and with the support members counter-pivoted in a second direction to torque the hip region of the patient in a direction opposite of FIG. 1*d*.

An upper opening 14 extends through the upper surface of the table 12 as illustrated in FIGS. 1*a* through 1*e* of the drawings. The upper opening 14 is positioned so that the hip region of a patient 16 lying upon the table 12 is approximately above the upper opening 14. As illustrated in FIGS. 1*c* through 1*e* of the drawings, the upper opening 14 exposes a cavity or similar passage that receives the mechanical components of the present invention with preferably only the support members 60, 70 extending upwardly through the upper opening 14. The upper opening 14 has a length sufficient to receive the support members 60, 70 and a width sufficient to receive the support members 60, 70 when they are fully separated without causing injury to a patient 16.

C. Vertical Adjustment Structure

The cavity or passage exposed by the upper opening 14 preferably has a lower floor that supports the mechanical components of the present invention. It can be appreciated that various other support structures may be utilized to support the components of the present invention. While the present invention may be positioned within the table 12 in a manner that does not allow for vertical adjustment for various types of patients 16, it is preferable that the present invention be supported within the table 12 in a vertically adjustable manner to accommodate various types of patients 16.

As illustrated in FIGS. 1*c* through 5 of the drawings, a base 20 is preferably utilized to support the mechanical components of the present invention. The base 20 is supported in a vertically adjustable manner by one or more vertical adjustment actuators 26 positioned between the base 20 and the floor of the cavity within the table 12 as best illustrated in FIGS. 1*a* through 1*e* of the drawings. The vertical adjustment actuators 26 allow for the vertical adjustment of the support members 60, 70 depending upon the type of patient 16 the medical procedure is to be performed upon. One or more sensors 28 may be utilized to determine the current vertical position. The vertical adjustment actuators 26 may be comprised of various types of actuators including but not limited to manually powered actuators (e.g. screw type, lever), electrical actuators, hydraulic actuators, pneumatic actuators and the like.

D. Support Members

FIGS. 1 through 5 illustrate the first support member 60 and the second support member 70 that extend through the upper opening 14 to engage the hip region of the patient 16. In particular, the support members 60, 70 preferably are adapted to extend between the buttocks of the patient 16 to allow for separation and manipulation of the sacroiliac joints of the patient 16 as illustrated in FIG. 1*c* of the drawings. The first support member 60 preferably mirrors and opposes the second support member 70 as illustrated in FIGS. 1*a* through 5 of the drawings. A first assembly 40 preferably supports the first support member 60 and a second assembly 50 preferably supports the second support member 70 independent of one another.

Figure 2:
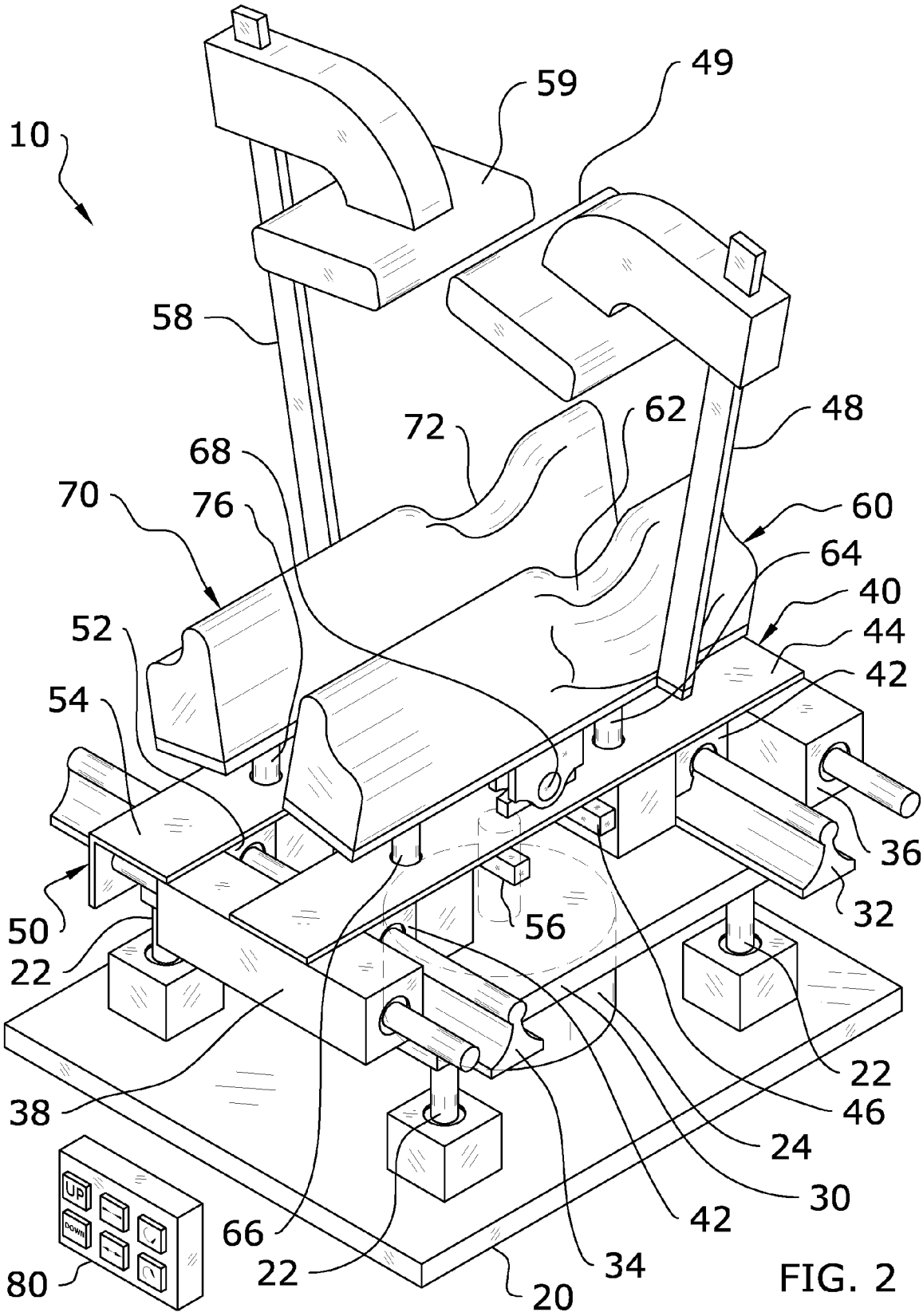
FIG. 2 is an upper perspective view of the present invention removed from the table.
Figure 4:
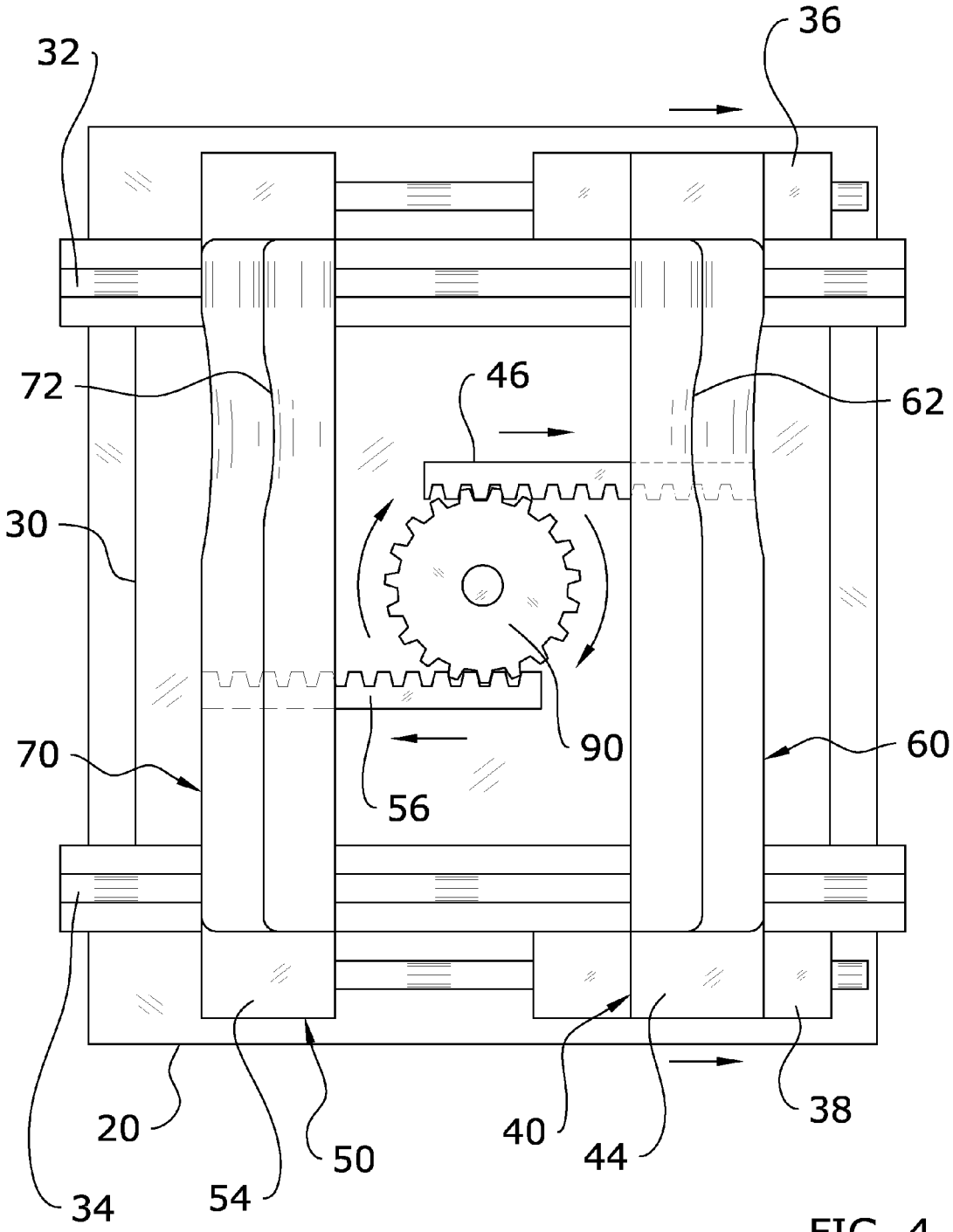
FIG. 4 is a top view of the present invention showing the rack and pinion assembly to ensure the support members are moved equally.
Figure 5:
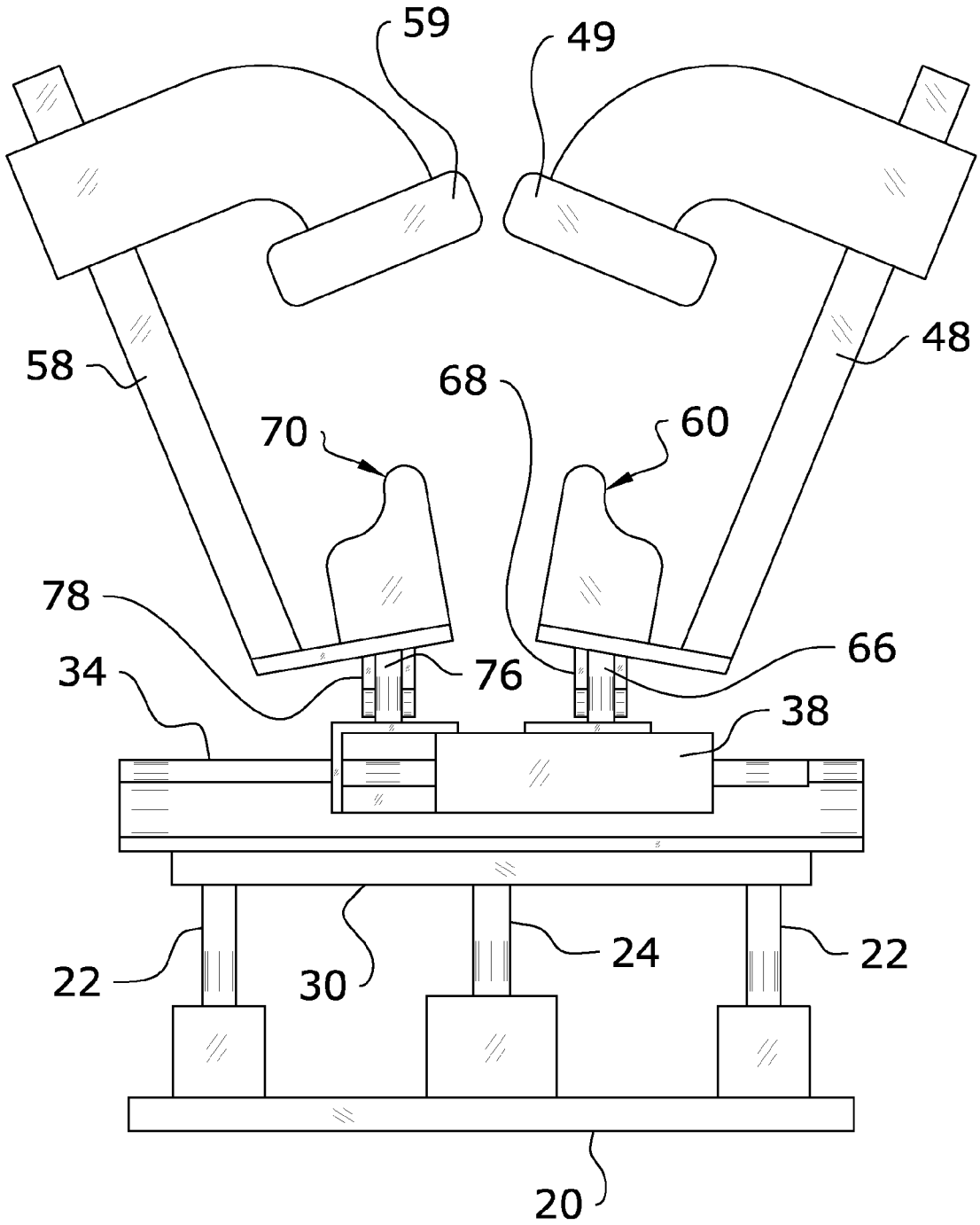
FIG. 5 is a front end view of the present invention.

The support members 60, 70 are preferably ergonomically formed to receive the buttocks of the patient 16 in a comfortable manner. The support members 60, 70 are preferably comprised of an elongated structure with an adjustable spacing between thereof. The first support member 60 preferably includes a first recess 62 and the second support member 70 preferably includes a second recess 72 to receive the buttocks around thereof as illustrated in FIGS. 2 and 4 of the drawings. It is preferable that an upper portion of the support members 60, 70 be comprised of a narrower or tapering structure to extend at least partially between the buttocks of the patient 16 during the medical procedure.

The upper portion of the support members 60, 70 is preferably comprised of a firm cushioned material. The lower portion of the support members 60, 70 is preferably comprised of a rigid material to support the length of the support members 60, 70 in a stable manner. Various other types of materials and configurations may be utilized to construct the support members 60, 70.

The support members 60, 70 are preferably substantially parallel to one another and are movable away from one another to separate the sacroiliac joints of the patient 16 as illustrated in FIG. 1*c* of the drawings. The support members 60, 70 are also preferably movable in a counter-rotational manner with respect to one another to apply a torque to the sacroiliac joints after or during separation of the sacroiliac joints so that the sacroiliac joints are positioned in a desired position according to X-rays and other observations of the sacroiliac joints. Finally, the support members 60, 70 preferably are capable of dropping downwardly in a quick manner to set the position of the sacroiliac joints. The support members 60, 70 therefore preferably separate, torque and drop the hip region of the patient 16 to perform the desired medical adjustment on the patient 16.

E. Separation Structure

The first support member 60 and the second support member 70 are adapted to move away from one another to separate the sacroiliac joints of the patient 16. A first member 44 preferably supports the first support member 60 in a movable manner and a second member 54 supports the second support member 70 in a movable manner. In particular, the first member 44 and the second member 54 preferably provide the side-to-side movement that allows for separation of the support members 60, 70. U.S. Pat. No. 6,077,293 to Dr. Wallace E. King discloses a related Chiropractic Table and is incorporated by reference herein for the purpose of disclosing a suitable separation structure.

The first member 44 and second member 54 are preferably slidably positioned upon a first rail 32 and a second rail 34 respectively as illustrated in FIGS. 1*c* through 5 of the drawings. The first member 44 preferably includes a pair of first slide units 42 that allow for relatively friction free sliding upon the first rail 32 and the second rail 34. The second member 54 preferably includes a pair of second slide units 52 that allow for relatively friction free sliding upon the first rail 32 and the second rail 34. The first rail 32 and second rail 34 are preferably parallel to one another. The first rail 32 and the second rail 34 are further parallel with respect to the side-to-side movement of the support members 60, 70 as best illustrated in FIG. 4 of the drawings. The first rail 32 and the second rail 34 are orthogonal with respect to the longitudinal axis of the table 12 that the patient 16 is positioned upon. The first member 44 and the second member 54 slide along the rails 32, 34 to move the support members 60, 70 side-to-side with respect to one another. The support members 60, 70 move side-to-side along a path orthogonal with respect to the spine of the patient 16.

At least one actuator is connected between the first member 44 and the second member 54 to separate and draw together the members 44, 54. It is preferable to use a first separator actuator 36 attached between first ends of the members 44, 54 and a second separator actuator 38 attached between second ends of the members 44, 54 as best illustrated in FIG. 4 of the drawings. The separator actuators 36, 38 may be comprised of various types of actuators including but not limited to manually powered actuators (e.g. screw type, lever), electrical actuators, hydraulic actuators, pneumatic actuators and the like.

It is further preferable to utilize a movement equalization system that provides for equal movement for each of the support members 60, 70 to prevent one of the support members 60, 70 from moving more than the other. It is preferable that a rack 46, 56 and pinion 90 be utilized to provide for equal side-to-side movement of the members 44, 54 wherein a first rack 46 is attached to the first member 44 and a second rack 56 is attached to the second member 54 substantially parallel to one another. The pinion 90 is positioned between the first rack 46 and the second rack 56 in a rotatable manner thereby distributing the movement of each of the members 44, 54 in an equal manner.

F. Torque Structure

In addition to the side-to-side separation of the support members 60, 70, the present invention further provides for torquing of the hip region of the patient 16 after or during the separation of the hip region. To accomplish the torquing, the first support member 60 and the second support member 70 are pivotally supported upon the first member 44 and the second member 54 respectively to allow for the torquing force to be applied to the hip region of the patient 16 positioned upon the table 12. The axis of rotation for the support members 60, 70 is preferably substantially orthogonal with respect to the path of separation movement of the support members 60, 70.

It is preferable that the first support member 60 pivots in a first rotational direction and the second support member 70 pivots in a second rotational direction that are counter to one another. In particular, the first rotational direction is preferably opposite of the second rotation direction to torque the hip region of the patient 16. When the patient 16 is first positioned upon the present invention, the support members 60, 70 are preferably substantially level as illustrated in FIG. 1*c* of the drawings. After or during the separation process, the support members 60, 70 are counter-rotated with respect to one another either mechanically or manually by the medical professional to apply a torque to the hip region to position the sacroiliac joints in a desired position.

A first hinge 68 is attached between the first support member 60 and the first member 44 as illustrated in FIGS. 1*c* through 3*c* of the drawings. A second hinge 78 is attached between the second support member 70 and the second member 54 as further illustrated in FIGS. 1*c* through 3*c* of the drawings. The first hinge 68 and the second hinge 78 may be positioned along various locations of the support members 60, 70 to provide various types of angular movement of the hip region of the patient 16.

The support members 60, 70 may be free to move on their own based upon the position of the patient 16 and the downward force applied to the patient 16 by the medical professional. However, it is preferable to have a mechanical force applied to the support members 60, 70 to cause the pivoting of the support members 60, 70 with respect to the patient 16.

In particular, it is preferably to have at least one actuator connected to each of the support members 60, 70 to apply a pivoting force that pivots the support members 60, 70 upon their respective members 44, 54. The actuator for each of the support members 60, 70 extends or retracts to achieve the desired pivoting movement upon the respective hinge 68, 78.

In the preferred embodiment, it is preferable to have a first front actuator 64 and a first rear actuator 66 connected to the first support member 60 to manipulate the rotational movement thereof. The first front actuator 64 is connected between the first support member 60 and the first member 44. The first front actuator 64 is connected to a front portion of the first support member 60. The first rear actuator 66 is connected between the first support member 60 and the first member 44 opposite of the first front actuator 64. The first rear actuator 66 is connected to a rear portion of the first support member 60 opposite of the first front actuator 64. The first front actuator 64 and the first rear actuator 66 are adapted to manipulate a first angle between the first support member 60 and the first member 44 as desired.

In the preferred embodiment, it is preferable to have a second front actuator 74 and a second rear actuator 76 connected to the second support member 70 to manipulate the rotational movement thereof. The second front actuator 74 is connected between the second support member 70 and the second member 54. The second front actuator 74 is connected to a front portion of the second support member 70. The second rear actuator 76 is connected between the second support member 70 and the second member 54 opposite of the second front actuator 74. The second rear actuator 76 is connected to a rear portion of the second support member 70 opposite of the second front actuator 74. The second front actuator 74 and the second rear actuator 76 are adapted to manipulate a second angle between the second support member 70 and the second member 54 as desired. The first angle is preferably a mirror angle of the second angle wherein the support members 60, 70 are counter-rotated with respect to one another thereby providing a torque upon the hip region of the patient 16 as illustrated in FIGS. 1*d*, 1*e*, 3*b*, 3*c* and 4 of the drawings.

The first front actuator 64, the first rear actuator 66, the second front actuator 74 and the second rear actuator 76 may be comprised of various types of actuators including but not limited to manually powered actuators (e.g. screw type, lever), electrical actuators, hydraulic actuators, pneumatic actuators and the like.

G. Dropping Structure

Figure 3A:
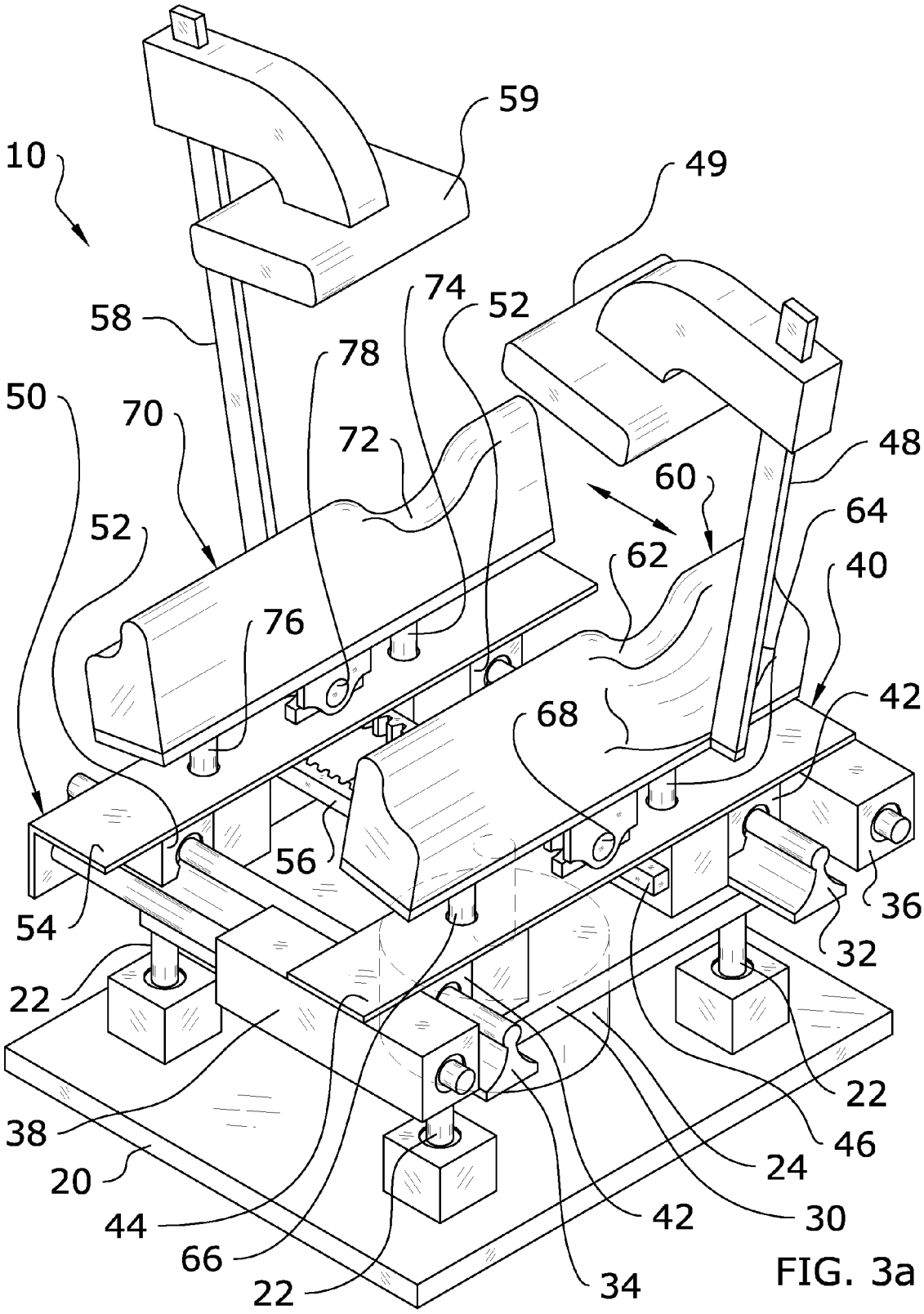
FIG. 3*a* is an upper perspective view of the present invention with the support members separated.
Figure 3B:
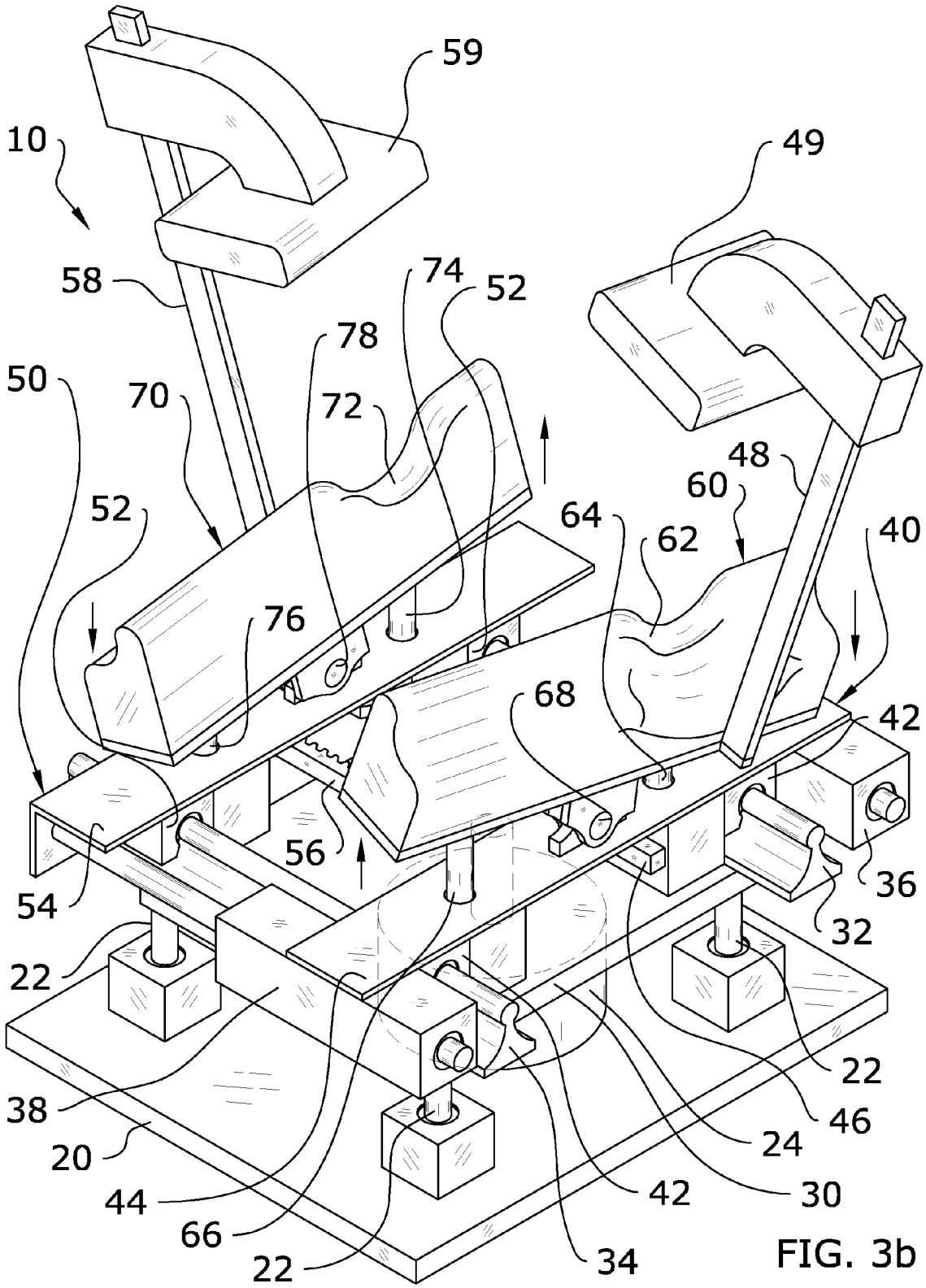
FIG. 3*b* is an upper perspective view of the present invention with the support members counter-pivoted in a first direction.
Figure 3C:
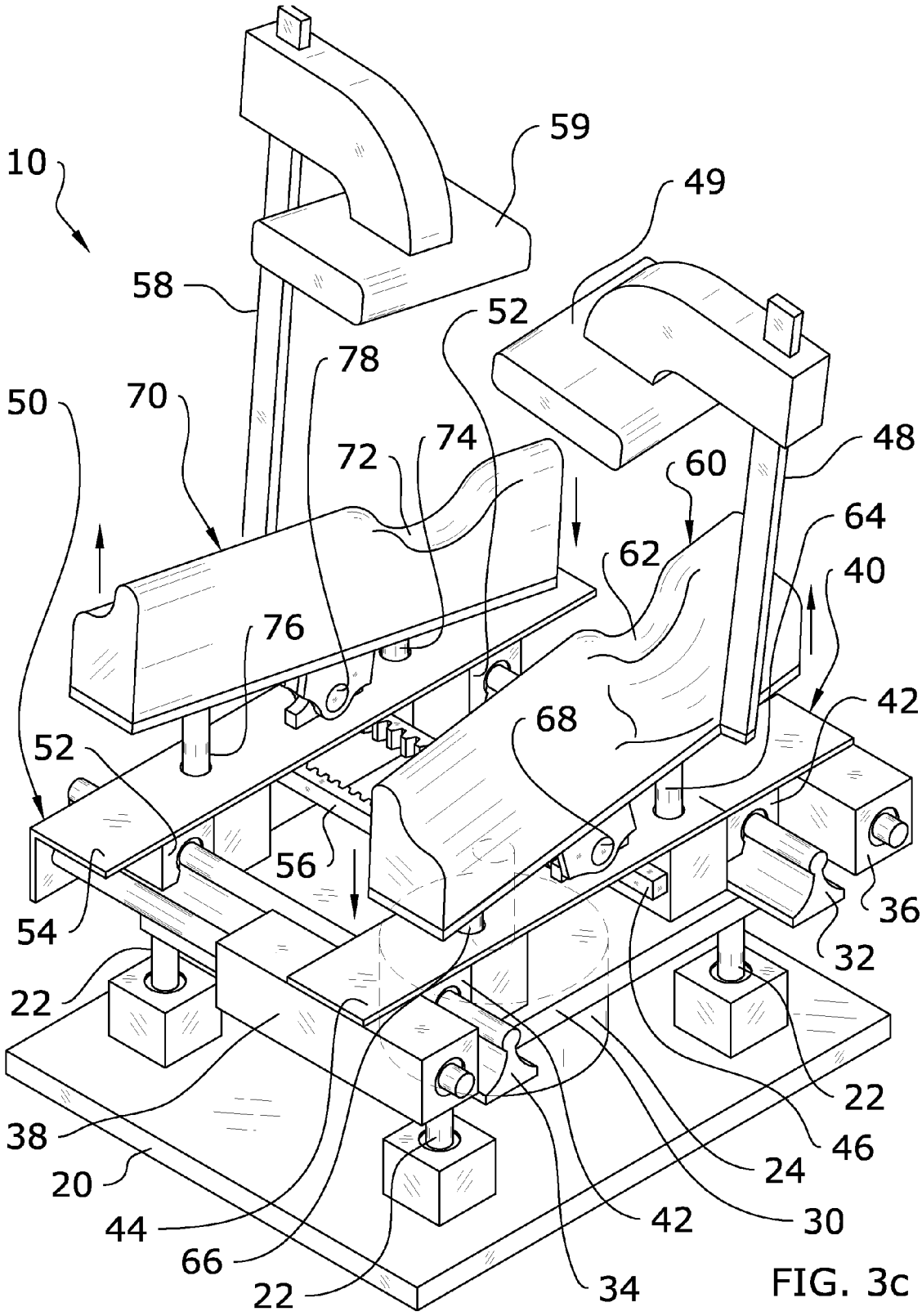
FIG. 3*c* is an upper perspective view of the present invention with the support members counter-pivoted in a second direction.
Figure 3D:
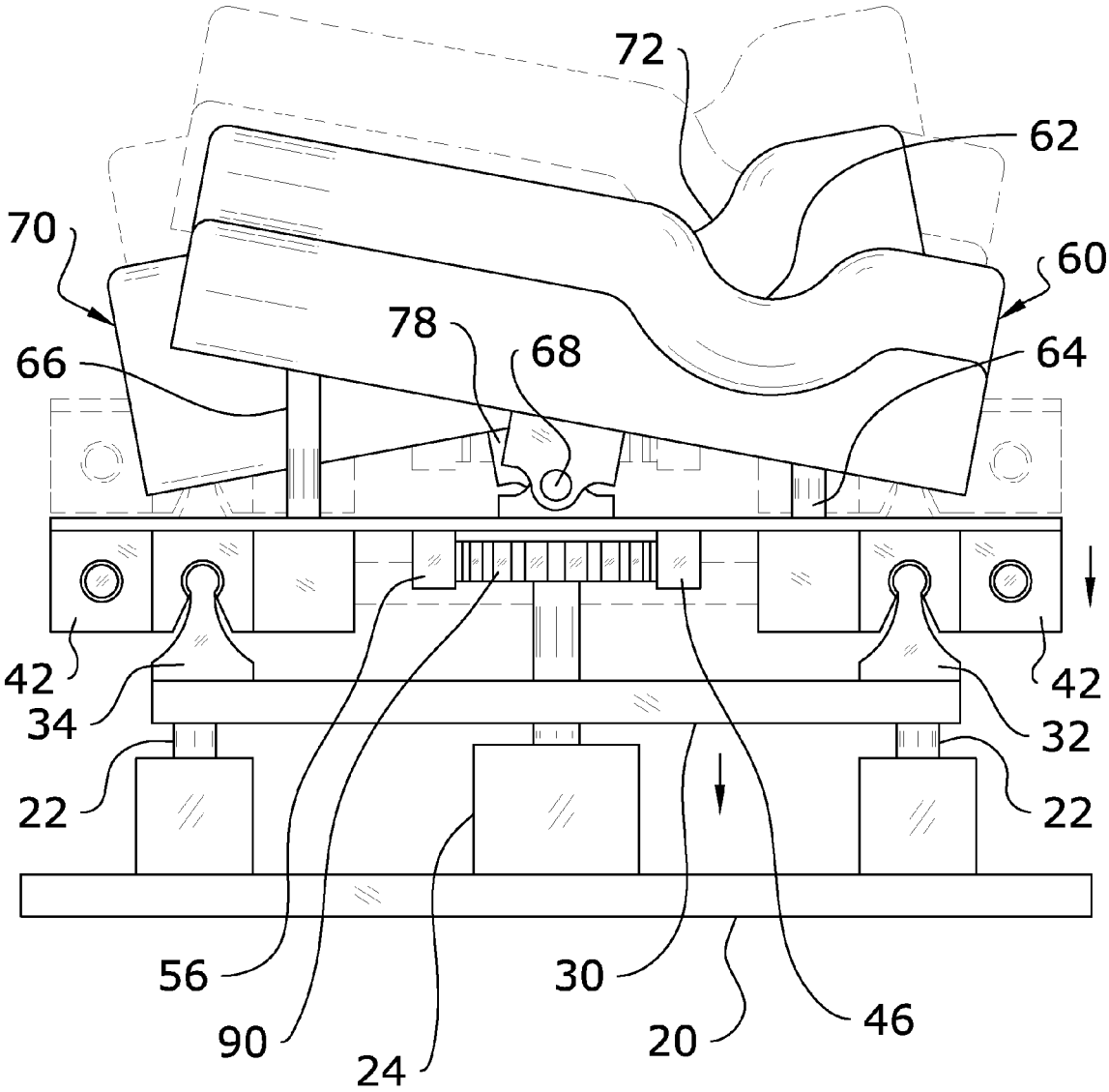
FIG. 3*d* is a side view of the present invention with the upper support lowered thereby lowering the support members.

The support members 60, 70 are further preferably adapted to quickly drop a finite distance after rotation of the first support member 60 or the second support member 70 to set the sacroiliac joints into a desired position. An upper support 30 preferably supports the rails 32, 34 as illustrated in FIG. 3*d* of the drawings.

The upper support 30 is supported above the base 20 by a drop actuator 24 that is capable of quickly lowering the upper support 30 which in turn quickly lowers the support members 60, 70 beneath the patient 16. The drop actuator 24 is preferably centrally positioned beneath the upper support 30 as illustrated in FIGS. 1*c* through 3*d* of the drawings. The drop actuator 24 may be comprised of various types of actuators including but not limited to manually powered actuators (e.g. screw type, lever), electrical actuators, hydraulic actuators, pneumatic actuators and the like that are capable of quickly lowering the upper support 30. It is further preferable to utilize one or more guide units 22 between the base 20 and the upper support 30 to provide for level movement of the upper support 30. The guide units 22 are preferably passive and allow for level movement of the upper support 30. In addition, one or more dampeners may be positioned between the base 20 and the upper support 30 to cushion the downward movement of the upper support 30 at a specific elevation. The range of downward movement allowed by the drop actuator 24 is preferably at least one inch.

H. Patient Retention Structure

To retain the hip region of the patient 16 upon the support members 60, 70, an adjustable retention structure is preferably utilized to apply at least a slight downward force upon the hip region above the support members 60, 70.

A first extended arm 48 preferably extends from the first support member 60 and extends upwardly away from the patient 16 as illustrated in FIGS. 1*c* through 3*c* of the drawings. A first engaging member 49 is preferably adjustably positioned upon the first extended arm 48 to allow for vertical adjustment of the first engaging member 49 with respect to the patient 16.

A second extended arm 58 preferably extends from the second support member 70 and extends upwardly away from the patient 16 as illustrated in FIGS. 1*c* through 3*c* of the drawings. A second engaging member 59 is preferably adjustably positioned upon the second extended arm 58 to allow for vertical adjustment of the second engaging member 59 with respect to the patient 16.

I. Control Unit

Figure 7:
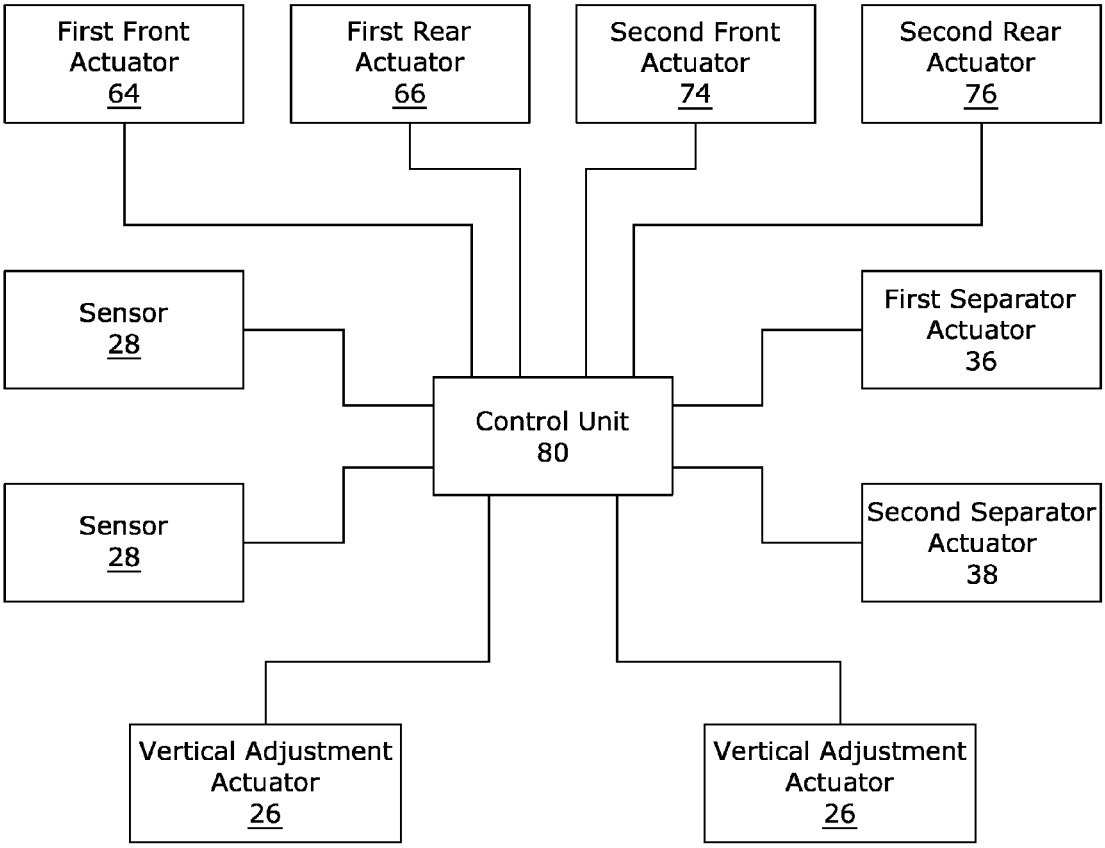
FIG. 7 is a block diagram illustrating the control unit in communication with the actuators and sensors used in the present invention.

The actuators of the present invention may be individually controlled manually or via a control unit 80. FIG. 7 illustrates a control unit 80 in communication with and controlling the actuators of the present invention. One or more sensors 28 are preferably utilized upon the present invention to provide feedback to the control unit 80 regarding the relative positions of various mechanical components (e.g. the distance between the support members 60, 70; the amount of rotation of the support members 60, 70; the distance of movement of drop actuator 24; a desired distance of separation of the support members 60, 70 to activate the rotation of the support members 60, 70; a desired rotation of the support members 60, 70 to activate the lowering of the drop actuator 24; a preset initial separation distance for the support members 60, 70, a preset vertical adjustment of the vertical adjustment actuators 26; etc.). The sensors 28 are preferably utilized to allow for automatic rotation of the support members 60, 70 after the support members 60, 70 are separated a desired distance. The sensors 28 are also preferably utilized to allow for automatic lowering of the drop actuator 24 after the automatic rotation of the support members 60, 70 occurs.

J. Alternative Embodiment

Figure 8:
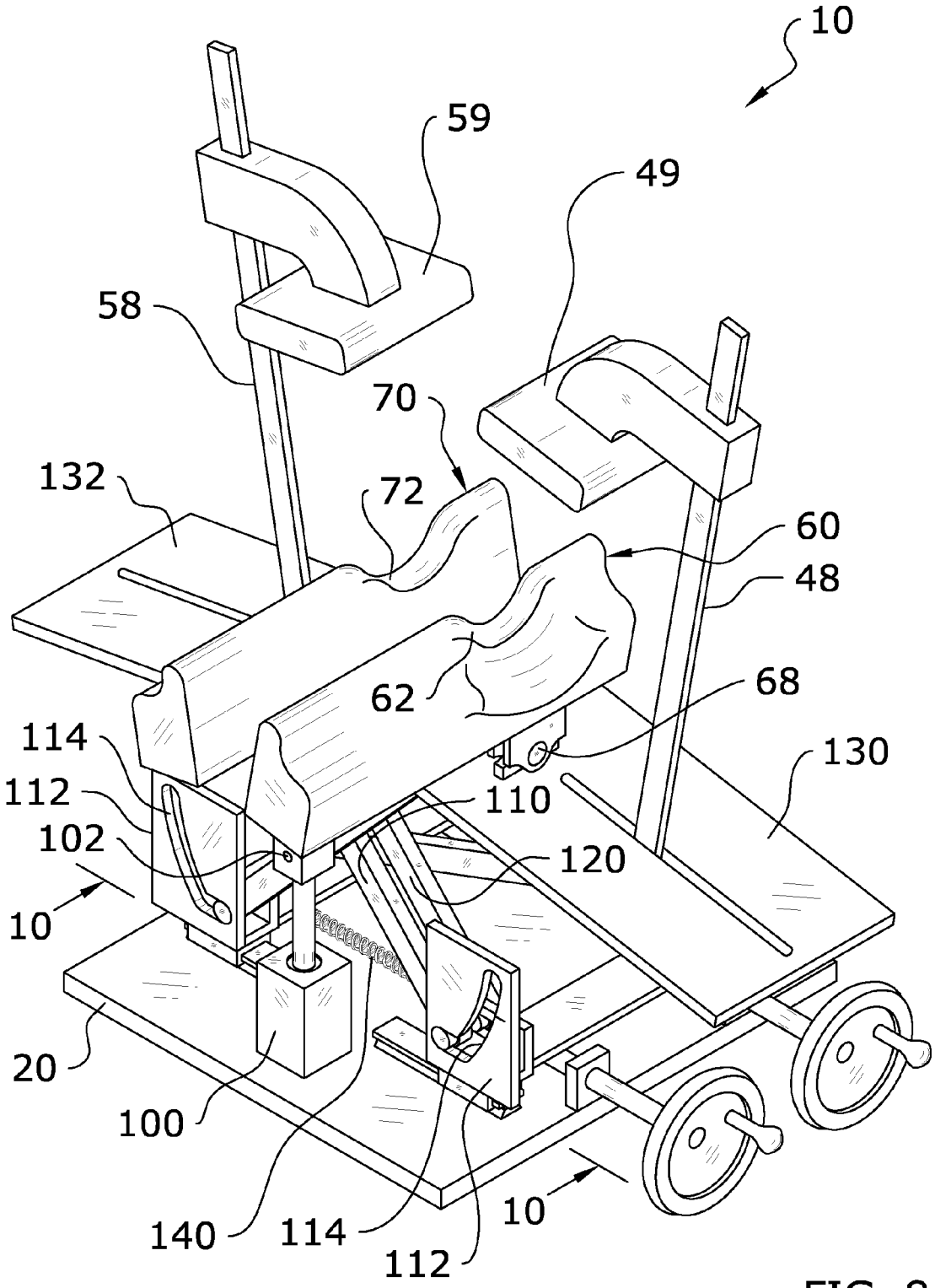
FIG. 8 is an upper perspective view of an alternative embodiment of the present invention.
Figure 9A:
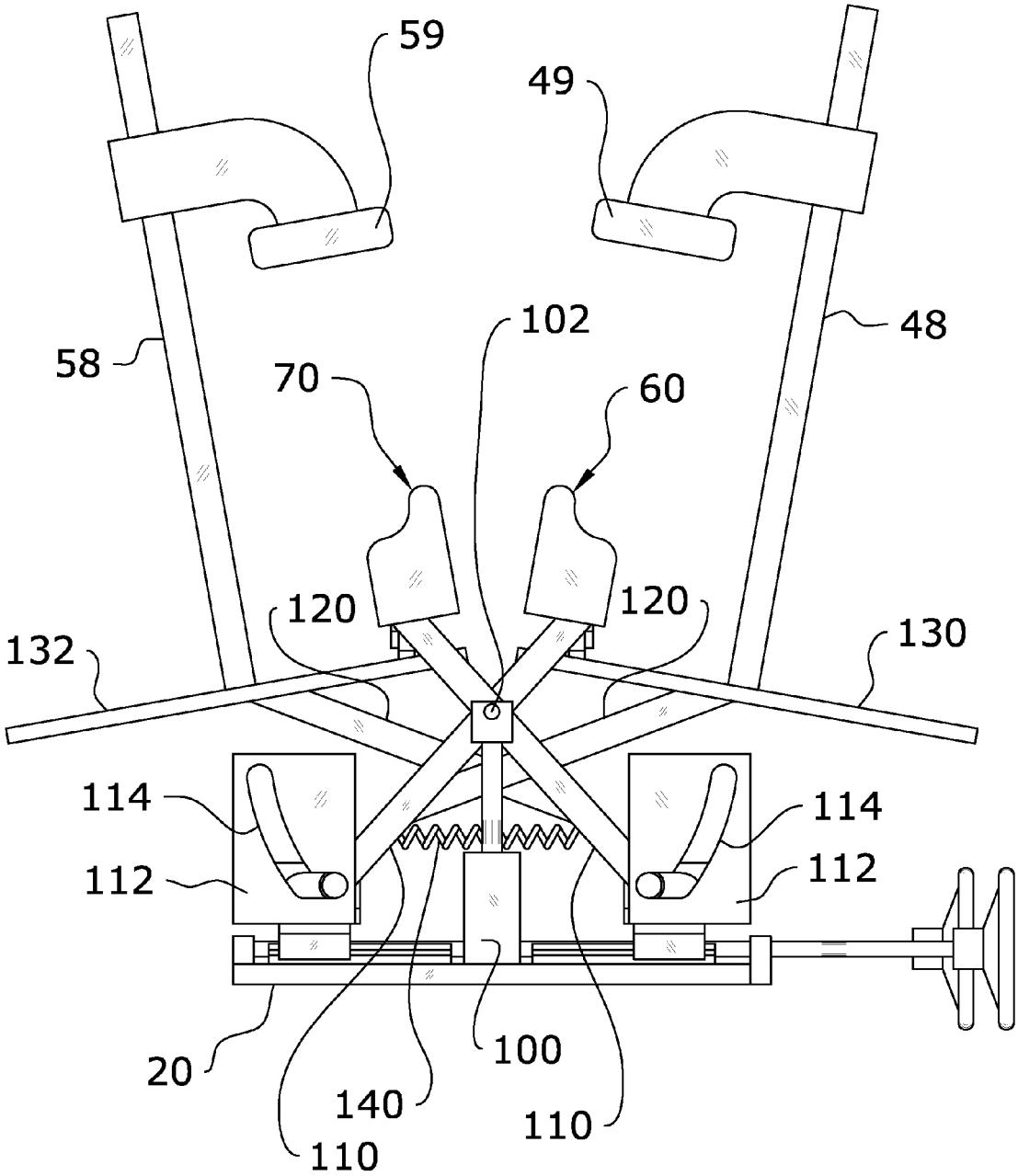
FIG. 9*a* is a front end view of the alternative embodiment of the present invention.
Figure 9B:
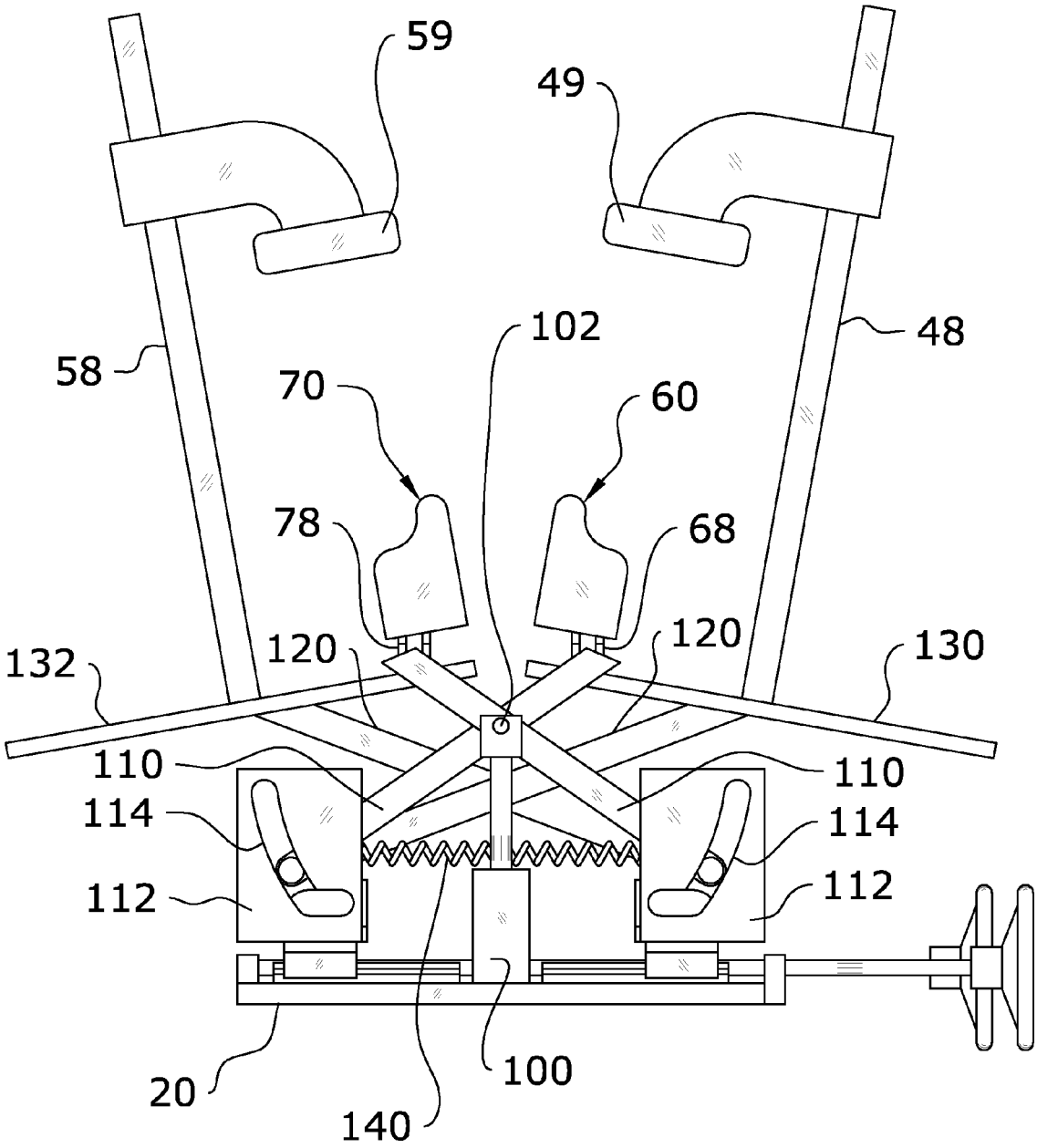
FIG. 9*b* is a front end view of the alternative embodiment of the present invention with the arms pivoted away from supporting the ends of the support members thereby allowing the support members to freely pivot.
Figure 10:
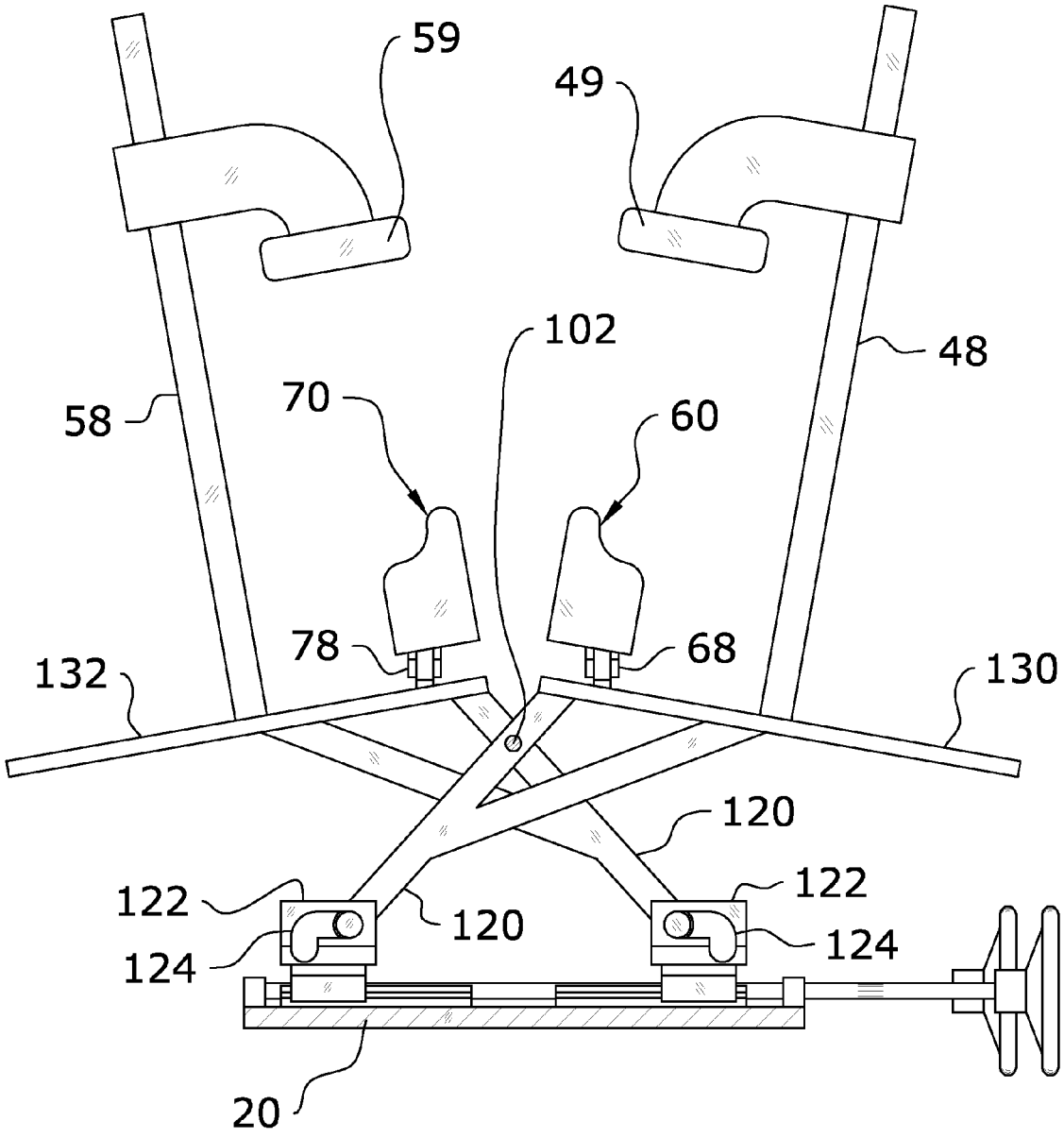
FIG. 10 is a cutaway view taken along line 10-10 of FIG. 8.

FIGS. 8 through 10 illustrate an alternative embodiment of the present invention that allows for a similar side-to-side separation movement of the support members 60, 70, counter-rotation of the support members 60, 70, and dropping of the support members 60, 70. In particular, the alternative embodiment utilizes the downward force of the medical professional to cause the desired movements of the support members 60, 70. As with the preferred embodiment, the alternative embodiment preferably is positioned within the table 12 such that the support members 60, 70 extend at least partially through the upper opening 14 of the table.

In particular, a first and second vertical bearing 100 are positioned upon opposite sides of the base 20 to support an axle 102 in a horizontal manner. The vertical bearing 100 freely moves in a vertical manner. The axle 102 pivotally supports a plurality of first arms 110 and second arms 120. A first platform 130 movably supports the first support member 60 and a second platform 132 movably supports the second support member 70 similar to as discussed previously in the preferred embodiment.

The second arms 120 support the platforms 130, 132 as illustrated in FIGS. 8 through 10 of the drawings. The first arms 110 support the distal end portions of the support members 60, 70 when the alternative embodiment is fully upright. A bias member 140 (e.g. a spring, hydraulic actuator, etc.) applies a drawing force upon the lower portion of the second arms 120 resulting in the support members 60, 70 to be retained upwardly until a downward force is applied.

The lower ends of the second arms 120 are movable within a second slot 124 within a second bracket 122 as illustrated best in FIG. 10 of the drawings. As the patient 16 is forced downwardly by the medical professional, the downward force is transferred to the support members 60, 70 and therefore to the second arms 120. The second arms 120 therefore lower the pivot axis about the axle 102 (in effect lowering the axle 102) with the lower distal ends of the second arms 120 extending outwardly a finite distance and with the upper distal ends of the second arms 120 causing the separation of the support members 60, 70. As the separation of the support members 60, 70 results in a desired separation of the hip region of the patient 16, the second guide pins of the second arms 120 within the second slots 124 drops downwardly suddenly following the downward portion of the second slots 124 as shown in FIG. 10 of the drawings. The sudden downward movement of the second arms 120 results in the quick lowering of the support members 60, 70 and the setting of the desired rotation of the hip region of the patient (i.e. setting the sacroiliac joints in the desired position).

The lower ends of the first arms 110 are movable within a first slot 114 within a first bracket 112 as illustrated in FIGS. 8 through 9*b* of the drawings. As the first arms 110 are pushed downwardly, the first guide pin within the first slot 114 moves outwardly in a horizontal manner initially and then outwardly and upwardly following the first slot 114. As the first arms 110 are pushed downwardly by the axle 102 (the medical professional is pushing downwardly upon the patient 16 which transfers the force to the second arms 120 which support the support members 60, 70), the upper ends of the first arms 110 are moved downwardly away from the bottom of the support members 60, 70 thereby allowing the support members 60, 70 to freely pivot upon the platforms 130, 132. The medical professional is able to apply a desired downward force in a desired location of the patient 16 to achieve the desired torsion to the hip region. When finished, the bias force from the bias member 140 returns the support members 60, 70 to the desired vertical location.

Various initial pre-settings may be utilized increase the bias force from the bias member 140 depending upon the weight of the patient 16. In addition, the desired vertical position of the support members 60, 70 may be achieved by limiting the initial position of the lower ends of the second arms 120 via various well known mechanical systems.

K. Operation of Preferred Embodiment

In use, the vertical adjustment actuators 26 are activated to achieve a desired height of the support members 60, 70 with respect to the upper surface of the table 12 based on the type of patient 16 to be manipulated. The support members 60, 70 are separated an initial distance apart based upon the type of patient 16. Furthermore, the amount of full separation of the support members 60, 70 is preferably preset based on the type of procedure to be performed. Furthermore, the amount of rotation and the direction of rotation of the support members 60, 70 to be performed is preferably preset based upon a prior examination of the patient 16 (e.g. with X-rays, physical inspection).

Figure 6:
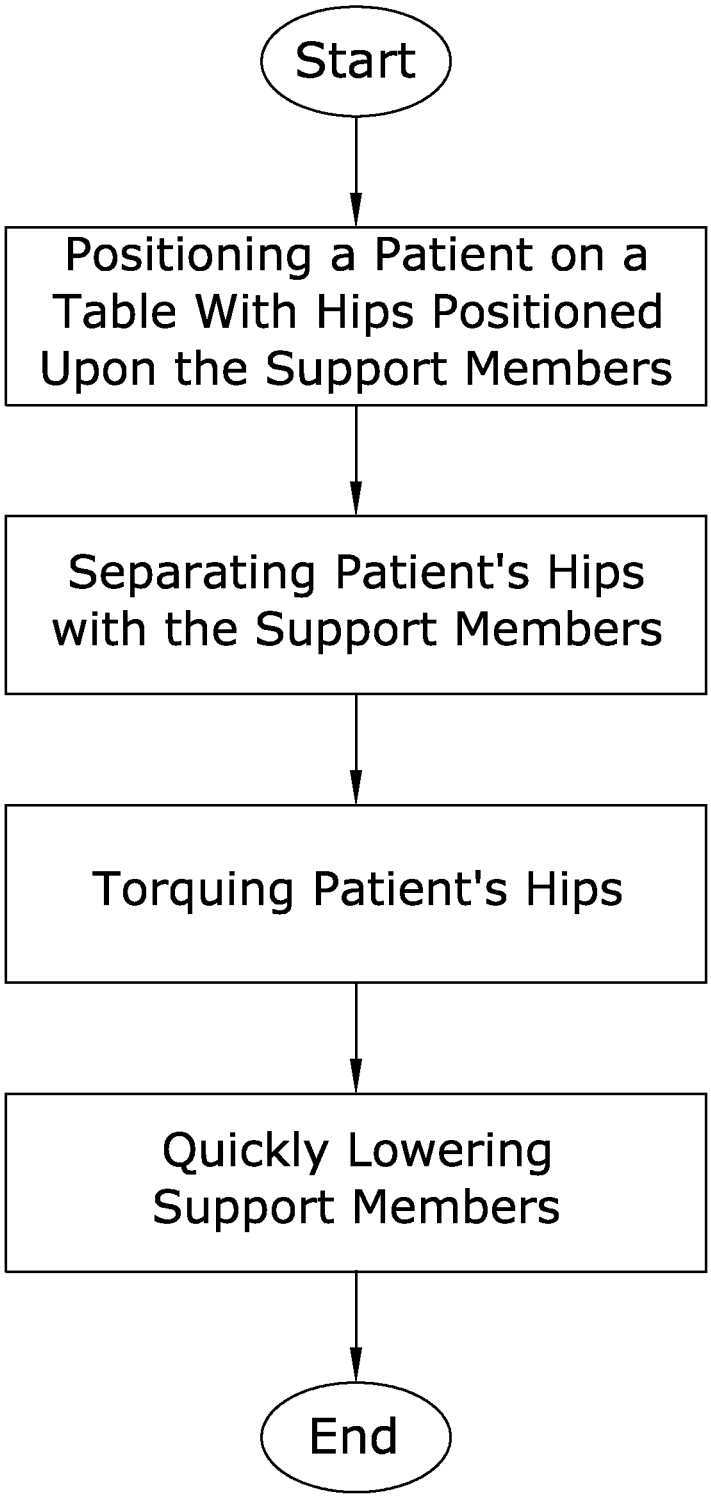
FIG. 6 is a flowchart illustrating the overall functionality of the present invention.

FIG. 6 of the drawings illustrates the overall process for the present invention. With the support members 60, 70 in a substantially initial level state, the patient 16 is then positioned upon the table 12 facing upwardly and with their hip region positioned upon the support members 60, 70 as illustrated in FIGS. 1*a* through 1*c* of the drawings. The engaging members 49, 59 are lowered upon the upper portion of the patient 16 to provide at least a slight retention force upon the patient 16 with respect to the support members 60, 70. With the patient 16 properly positioned upon the support members 60, 70, the upper portion of the support members 60, 70 extend at least partially between the buttocks of the patient 16.

Once the patient 16 is properly positioned upon the support members 60, 70, the medical professional activates the control unit 80 causing the separator actuators 36, 38 to separate the hip region of the patient 16 to a desired distance thereby loosening the sacroiliac joints which allows for later torsional manipulation by the support members 60, 70 as illustrated in FIGS. 1*c* and 4 of the drawings.

Once the support members 60, 70 are separated a desired distance (e.g. 4 inches), a sensor 28 detects the distance and stops the separator actuators 36, 38 from moving further. In addition, after detection of the desired separation distance, the control unit 80 then activates the front and rear actuators 64, 66, 74, 76 accordingly to cause the desired counter rotation of the support members 60, 70 with respect to one another as illustrated in FIGS. 1*d* and 1*e* of the drawings. The support members 60, 70 are rotated to a desired angle as preset and then another sensor 28 detects the desired angle to stop further rotation of the support members 60, 70.

Once the desired rotational angle for the support members 60, 70 has been achieved, the hip region of the patient 16 is now separated and torqued to the desired position. The control unit 80 then preferably automatically drops/lowers the support members 60, 70 by activating the drop actuator 24 which quickly lowers the present invention. The quick lowering of the support members 60, 70 allows the sacroiliac joints to remain in the desired set position while allowing the sacroiliac joints to come together because the support members 60, 70 lower sufficient so that they no longer separate the hip region of the patient 16.

The procedure may be repeated if deemed necessary by the medical professional. When finished, the patient 16 is removed from the table 12 and the support members 60, 70 are set to a desired initial position for the next patient 16.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A chiropractic table for treating a patient, comprising:

a table having an upper surface and an upper opening extending through said upper surface, wherein said upper opening is positioned within said upper surface and is adapted to be positioned approximately beneath a hip region of the patient when the patient is lying upon said table;

a first support member extending through said upper opening;

a first member supporting said first support member in a movable manner;

a second support member extending through said upper opening;

a second member supporting said second support member in a movable manner;

wherein said first support member and said second support member move side-to-side;

wherein said first support member and said second support member are pivotally supported upon said first member and said second member respectively;

a first hinge attached between said first support member and said first member;

a second hinge attached between said second support member and said second member;

wherein said first support member pivots in a first pivotal direction along a first plane and said second support member pivots in a second pivotal direction along a second plane;

wherein said first pivotal direction is opposite of said second pivotal direction to torque the hip region of the patient; and a first patient retention structure directly attached to said first support member and a second patient retention structure directly attached to said second support member, wherein said patient retention structures are adapted to apply a downward force upon the hip region of the patient to retain the hip region of the patient upon said support members.

2. The chiropractic table of claim 1, wherein said first support member mirrors said second support member.

3. The chiropractic table of claim 1, wherein said first support member and said second support member oppose one another.

4. The chiropractic table of claim 1, wherein said first support member and said second support member are each comprised of elongated structures, and wherein said first support member is substantially parallel with respect to said second support member.

5. The chiropractic table of claim 1, wherein said first support member includes a first recess and wherein said second support member includes a second recess adapted to receive an interior portion of the hip region of the patient positioned upon said table.

6. The chiropractic table of claim 1, wherein said first support member and said second support member are adapted to drop a finite distance.

7. The chiropractic table of claim 1, wherein said patient retention structures are adjustable.

8. The chiropractic table of claim 1, wherein said first patient retention structure is comprised of a first extended arm extending upwardly from said first support member and a first engaging member positioned upon said first extended arm, and wherein said second patient retention structure is comprised of a second extended arm extending upwardly from said second support member and a second engaging member positioned upon said second extended arm, wherein said engaging members are adapted to engage the hip region of a patient.

9. The chiropractic table of claim 8, wherein said first engaging member is adjustably positioned upon said first extended arm to allow for vertical adjustment of said first engaging member, and wherein said second engaging member is adjustably positioned upon said second extended arm to allow for vertical adjustment of said second engaging member.

10. The chiropractic table of claim 9, wherein said engaging members extend inwardly toward one another from said extended arms.

11. A chiropractic table for treating a patient, comprising:

a table having an upper surface and an upper opening extending through said upper surface, wherein said upper opening is positioned within said upper surface and is adapted to be positioned approximately beneath a hip region of the patient when the patient is lying upon said table;

a first support member extending through said upper opening;

a first member supporting said first support member in a movable manner;

a first actuator connected between said first support member and said first member, wherein said first actuator is adapted to manipulate a first angle between said first support member and said first member;

a second support member extending through said upper opening;

a second member supporting said second support member in a movable manner;

a second actuator connected between said second support member and said second member, wherein said second actuator is adapted to manipulate a second angle between said second support member and said second member;

wherein said first support member and said second support member move side-to-side;

wherein said first support member and said second support member are pivotally supported upon said first member and said second member respectively;

wherein said first support member pivots in a first pivotal direction along a first plane and said second support member pivots in a second pivotal direction along a second plane;

wherein said first pivotal direction is opposite of said second pivotal direction to torque the hip region of the patient; and a first patient retention structure directly attached to said first support member and a second patient retention structure directly attached to said second support member, wherein said patient retention structures are adapted to apply a downward force upon the hip region of the patient to retain the hip region of the patient upon said support members.

12. The chiropractic table of claim 11, wherein said first support member mirrors said second support member.

13. The chiropractic table of claim 11, wherein said first support member and said second support member oppose one another.

14. The chiropractic table of claim 11, wherein said first support member and said second support member are each comprised of elongated structures, and wherein said first support member is substantially parallel with respect to said second support member.

15. The chiropractic table of claim 11, wherein said first support member includes a first recess and wherein said second support member includes a second recess adapted to receive an interior portion of the hip region of the patient positioned upon said table.

16. The chiropractic table of claim 11, including a first hinge attached between said first support member and said first member, and a second hinge attached between said second support member and said second member.

17. A chiropractic table for treating a patient, comprising:

a table having an upper surface and an upper opening extending through said upper surface, wherein said upper opening is positioned within said upper surface and is adapted to be positioned approximately beneath a hip region of the patient when the patient is lying upon said table;

a first support member extending through said upper opening;

a first member supporting said first support member in a movable manner;

a first front actuator connected between said first support member and said first member, wherein said first front actuator is connected to a front portion of said first support member;

a first rear actuator connected between said first support member and said first member, wherein said first rear actuator is connected to a rear portion of said first support member, wherein said first front actuator and said first rear actuator is adapted to manipulate a first angle between said first support member and said first member;

a second support member extending through said upper opening;

a second member supporting said second support member in a movable manner;

wherein said first support member and said second support member are adapted to move away from one another to separate sacroiliac joints of the patient;

a second front actuator connected between said second support member and said second member, wherein said second front actuator is connected to a front portion of said second support member, wherein said second front actuator is adapted to manipulate a second angle between said second support member and said second member; and a second rear actuator connected between said second support member and said second member, wherein said second rear actuator is connected to a rear portion of said second support member, wherein said second front actuator and said second rear actuator is adapted to manipulate said second angle between said second support member and said second member, wherein said first angle is a mirror angle of said second angle;

a first patient retention structure directly attached to said first support member and a second patient retention structure directly attached to said second support member, wherein said patient retention structures are adapted to apply a downward force upon the hip region of the patient to retain the hip region of the patient upon said support members.

* * * * *